US006681861B2

(12) United States Patent
Davidson et al.

(10) Patent No.: US 6,681,861 B2
(45) Date of Patent: Jan. 27, 2004

(54) POWER SYSTEM FOR A WELL

(75) Inventors: Kenneth C. Davidson, Sugar Land, TX (US); John A. Kerr, Sugar Land, TX (US); Roderick MacKenzie, Sugar Land, TX (US); Alan J. Johnston, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 2 days.

(21) Appl. No.: 10/170,808

(22) Filed: Jun. 13, 2002

(65) Prior Publication Data

US 2002/0189817 A1 Dec. 19, 2002

Related U.S. Application Data

(60) Provisional application No. 60/298,691, filed on Jun. 15, 2001.

(51) Int. Cl.[7] ..... E21B 33/03

(52) U.S. Cl. ..... 166/382; 166/65.1; 166/191

(58) Field of Search ..... 166/378, 379, 166/382, 55.1, 66.4, 65.1, 191, 194

(56) References Cited

U.S. PATENT DOCUMENTS

| | | | | |
|---|---|---|---|---|
| 3,638,732 | A | * | 2/1972 | Huntsinger et al. ..... 166/379 |
| 4,154,302 | A | * | 5/1979 | Cugini ..... 166/378 |
| 4,289,199 | A | * | 9/1981 | McGee ..... 166/65.1 |
| 4,491,176 | A | * | 1/1985 | Reed ..... 166/66.4 |
| 4,600,054 | A | * | 7/1986 | Miller et al. ..... 166/65.1 |
| 5,052,941 | A | * | 10/1991 | Hernandez-Marti et al. ..... 439/194 |
| 5,577,925 | A | * | 11/1996 | Schnatzmeyer et al. .... 439/191 |
| 6,192,983 | B1 | | 2/2001 | Neuroth et al. |
| 6,200,152 | B1 | | 3/2001 | Hopper |
| 6,202,743 | B1 | | 3/2001 | Moore |
| 6,223,825 | B1 | | 5/2001 | Ingebrigtsen et al. |
| 6,227,300 | B1 | | 5/2001 | Cunningham et al. |
| 2002/0014336 | A1 | | 2/2002 | Jones |

* cited by examiner

*Primary Examiner*—Frank Tsay
(74) *Attorney, Agent, or Firm*—Trop, Pruner & Hu, P.C.; Jeffrey E. Griffin; Brigitte Jeffery Echols

(57) ABSTRACT

A system that is usable with a well includes a structure that has a region that is adapted to receive a tubing hanger interface. The system also includes at least one communication connection that penetrates the structure below the region to receive the tubing hanger interface.

57 Claims, 10 Drawing Sheets

POWER SYSTEM FOR A WELL

This application claims the benefit, pursuant to 35 U.S.C. §119, to U.S. Patent Application Serial No. 60/298,691, filed on Jun. 15, 2001.

BACKGROUND

The invention generally relates to a power system for a well, such as a power system to deliver power to electrical equipment of a subsea well, for example.

A subterranean well typically includes various pieces of electrical equipment (an electrical submersible pump and an electrical flow pump, as examples) that are located downhole inside the well. For purposes of providing power to operate this electrical equipment, electrical cables may be run through an annular area between a production tubing and casing string of the well down to the electrical equipment.

The primary purpose of production tubing is to communicate produced well fluids from subterranean formations of the well to the surface of the well. Typically, a tubing hanger interface suspends the production tubing in the well. In this manner, the tubing hanger interface is secured to a well tree of the well, and the top end of the production tubing typically is threaded into the tubing hanger interface.

One or more electrical cables typically communicate power from an external power source (i.e., a power source that is located outside of the well) to the electrical cable(s) that are located inside the well. For purposes of forming electrical connections between the electrical cable(s) that are inside of the well and the electrical cable(s) that are outside of the well, a conventional technique involves penetrating the well tree with electrical connections so that these electrical connections enter the well either through the tubing hanger interface or above the tubing hanger interface. In this manner, downhole electrical cables typically are connected to these penetrating electrical connections and routed through the tubing hanger interface into the annular area between the production tubing and casing string. The electrical cables extend down the annular area to the downhole electrical equipment.

The above-described arrangement may present various design challenges. For example, the tubing hanger body is often crowded due to the presence of electrical connections, hydraulic control lines, etc. Therefore, to prevent the tubing hanger body from becoming too constricted, a limitation may be imposed on the cross-sectional area of each electrical cable, and a limitation may be imposed on the total number of electrical cables that may be extended downhole. These limitations, in turn, restrict the amount of power that may be communicated downhole.

Thus, there is a continuing need for a technique and/or system for delivering power to electrical equipment that is located in a well.

SUMMARY

In an embodiment of the invention, a system that is usable with a well includes a structure that has a region that is adapted to receive a tubing hanger interface. The system also includes at least one communication connection that penetrates the structure below the region that receives the tubing hanger interface.

In another embodiment of the invention, a power system for providing power communications to downhole devices in a well that has a tubing hanger interface includes an external power source, a downhole structure and a power structure. The downhole structure has external electrical contacts that are connected therethrough the downhole structure to internal electrical contacts. The external electrical contacts are in communication with the external power source and are located below the tubing hanger interface. The power structure has outer electrical contacts in communication with inner electrical contacts. The outer electrical contacts are adapted for communication with the internal electrical contacts of the downhole structure, and the inner electrical contacts are adapted to supply power to the downhole devices.

Advantages and other features of the invention will become apparent from the following description, drawing and claims.

DETAILED DESCRIPTION

Figure 1:
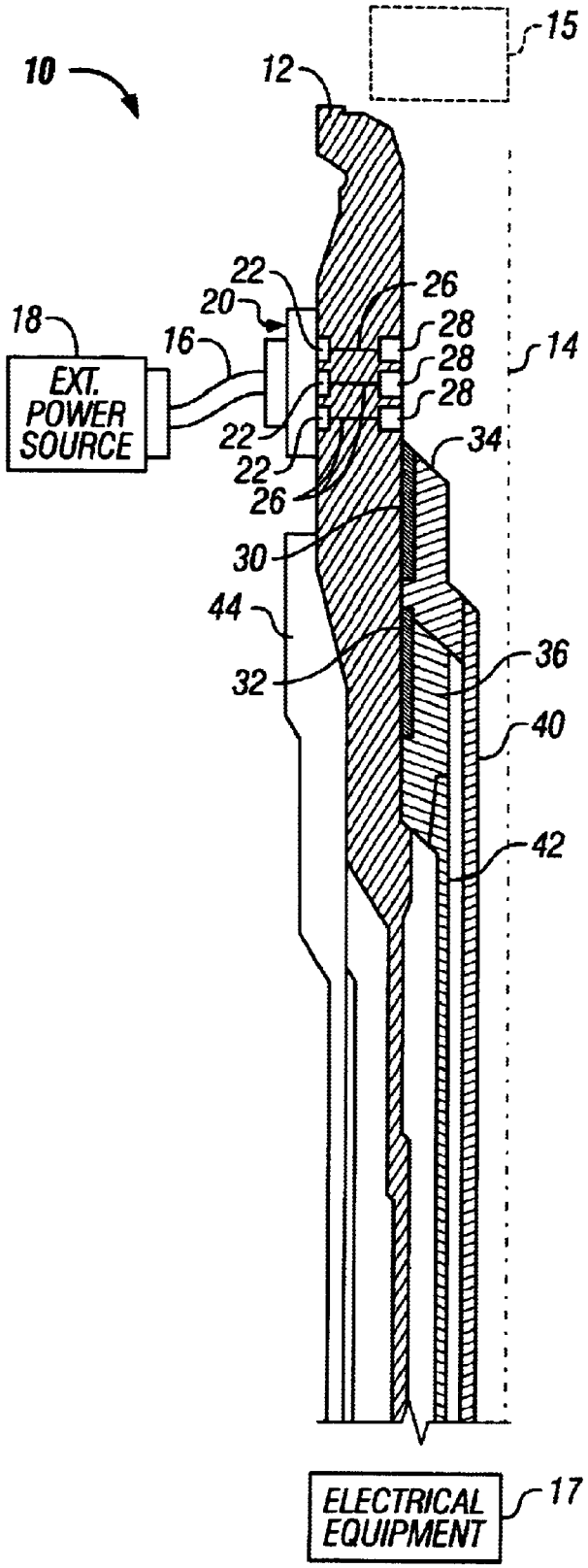
FIG. 1 is a schematic diagram of a well before installation of a power hanger and a tubing hanger interface according to an embodiment of the invention.

FIG. 1 depicts an embodiment 10 of a well (a subsea well, for example) in accordance with the invention. The full cross-sections of tubular members in FIG. 1 and the proceeding figures are not shown, but rather, the left-hand cross-sections of these members are shown in relation to a longitudinal axis 14 of the well. Thus, it is understood that the left-hand cross-sections of a particular tubular member may be rotated about the longitudinal axis 14 to form the corresponding right-hand cross-section of the tubular member.

One such tubular member that is depicted in FIG. 1 is a wellhead 12, a structure that provides support for a well casing that extends into the wellbore. For a subsea well, the wellhead 12 extends into the sea floor. Depending on the particular embodiment of the invention, either a small diameter well casing hanger 34 (from which a small diameter casing 40 hangs and extends into the wellbore) or a larger diameter well casing hanger 36 (from which a larger diameter well casing 42 hangs and extends into the wellbore) may be secured to the wellhead 12. The well casing hanger 34 may be sealed to the wellhead 12 via a seal 30, and the well casing hanger 36 may be sealed to the wellhead 12 via a seal 32.

The well 10 may have one or more pieces of downhole electrical equipment 17, such as flow pumps and submersible pumps (as examples), that need electrical power to operate. As described below, the well 10 has features that facilitate the communication of electrical power from wires of an external electrical power cable assembly 16 to the electrical equipment 17 inside the well. The power cable assembly 16 communicates power from an external power source 18. As an example, the external power source 18 may be located on a surface platform for the case in which the well 10 is a subsea well.

In some embodiments of the invention, for purposes of communicating electrical power from outside the well to inside the well, insulated electrical conduits 26 penetrate the sidewall of the wellhead 12. Seals are formed between the conduits 26 and the sidewall of the wellhead 12 where the conduits 26 penetrate the sidewall to preserve the pressure sealing capability of the wellhead 12. The conduits 26 are electrically connected to electrical connectors 22 that are exposed on the exterior surface of the sidewall of the wellhead 12. A power interface connector 20 mates with the connectors 22, seals the connectors 22 from the surrounding environment and communicates electricity from wires of the cable assembly 16 to the connectors 22.

The conduits 26 extend through the sidewall of the wellhead 12 to electrical connectors 28 that are exposed on an interior surface on the sidewall of the wellhead 12. As described below, a power hanger (not depicted in FIG. 1) is installed inside the wellhead 12 for purposes of extending electrical connections from the connectors 28 to one or more power cables (not depicted in FIG. 1) that are run downhole to the electrical equipment 17.

As described below, a tubing hanger interface (not depicted in FIG. 1) is installed in the well 10 above the connectors 28 in a region 15 (see also FIG. 5A) that is adapted to receive the tubing hanger interface. As described below, this region 15 may be formed by part of a well tree of the well. Due to the penetration of the electrical connections below the tubing hanger interface, the downhole cable (s) that are electrically connected to the connectors 28 may be run along the outside surface of a production tubing (not depicted in FIG. 1) of the well 10, and are not limited to the restrictions imposed through the tubing hanger body.

Figure 2:
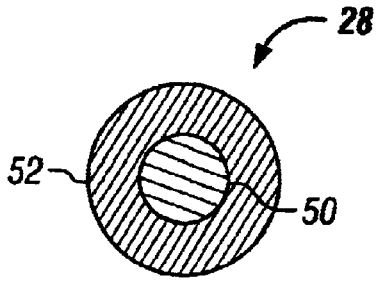
FIG. 2 is a schematic diagram of an electrical connector of the well of FIG. 1 according to an embodiment of the invention.

Referring to FIG. 2, as an example, a particular connector 28 may include an interior electrically conductive region 50, in some embodiments of the invention. This conductive region 50 provides a contact point for purposes of electrically mating the connector 28 with a corresponding electrically conductive region of another connector (described below) inside the well 10. The conductive region 50 is surrounded by a dielectric material 52 that insulates the conductive region 50 from the surrounding conductive wellhead 12. Other connectors described herein may have a similar structure. Other types of connectors may alternatively be used in other embodiments of the invention.

Figure 3A:
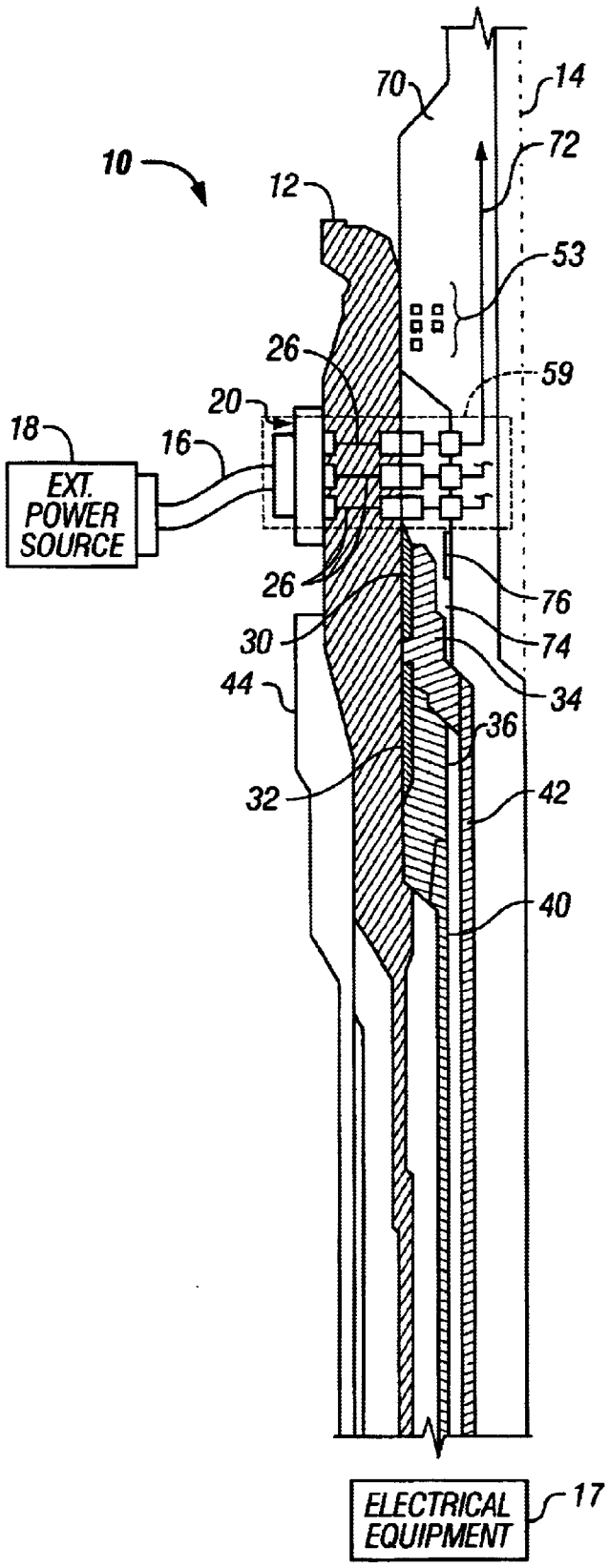
FIG. 3A is a schematic diagram of the well of FIG. 1 after the entry of a power hanger and a power hanger running tool into the well according to an embodiment of the invention.
Figure 3B:
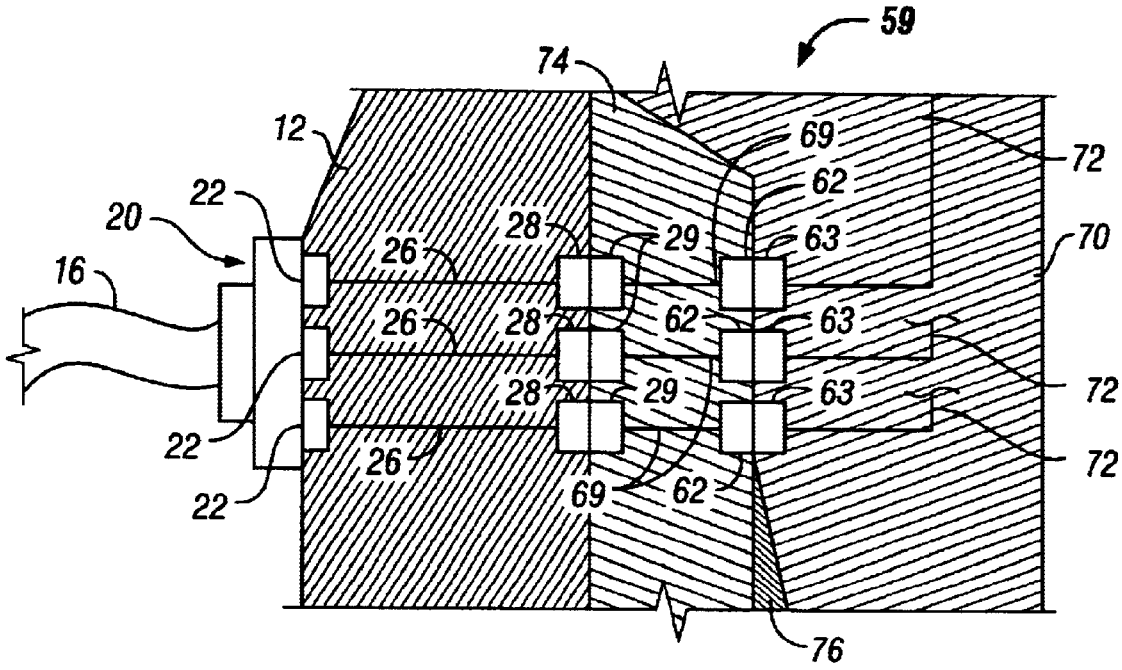
FIG. 3B is a more detailed schematic diagram of a selected portion of the well of FIG. 3A depicting electrical connections according to an embodiment of the invention.

FIG. 3A depicts the well 10 when a power hanger running tool 70 is disposed within the well 10. FIG. 3B depicts a more detailed illustration of a portion 59 of the well 10, showing the electrical connections that penetrate the wellhead 12. Referring both to FIGS. 3A and 3B, as its name implies, the power hanger running tool 70 is used to run a power hanger 74 in the wellhead 10. The power hanger 74 provides protection for the electrical connectors 28 (FIG. 3B), as well as provides electrical connections between these connectors 28 and electrical connectors (described below) of a tubing hanger extension.

The power hanger 74 is run downhole inside the well 10 via the tool 70 and is attached to the wellhead 12 by activation of the running tool 70. In this manner, for purposes of running the tool 70 into the well 10, the power hanger 74 is latched or secured to the running tool 70. When the power hanger 74 is in the appropriate position inside the well 10, the running tool 70 activates a locking mechanism (dogs, for example) of the power hanger 74 so that the power hanger 74 latches onto the interior surface of the sidewall of the wellhead 12.

Before the running tool 70 sets the power hanger, a dielectric fluid may be injected into the well for purposes of cleaning the exposed electrical connections in the well. In this manner, this cleaning ensures effective electrical contacts and effective insulation surrounding these contacts. Thus, in some embodiments of the invention, when the power hanger running tool 70 is positioned near the electrical connectors 28, a dielectric fluid may be injected into the well to clean exposed electrical connectors, such as the connectors 28. As an example, the dielectric fluid may be injected into the well via radial ports 53 (FIG. 3A) of the running tool 70. The dielectric fluid may be introduced from the surface of the well and flow downhole from the surface to these ports 53, in some embodiments of the invention.

For purposes of setting the power hanger 74, the running tool 70 orients the position of the power hanger 74 so that the electrical connectors 28 are aligned with corresponding electrical connectors 29 (FIG. 3B) of the power hanger 74. When the power hanger 74 is set, the electrical connectors 28 and 29 mate. As an example, the electrical connectors 28 may be female connectors, and the electrical connectors 29 may be male connectors. Other variations are possible.

When latched to the power hanger 74, the running tool 70 has electrical connectors 63 (FIG. 3B) that mate with corresponding electrical connectors 62 of the power hanger 74. The electrical connectors 62 are located on the inner surface of the tubing hanger 74 and are connected to the connectors 29 on the outer surface of the tubing hanger 74 via insulated electrical conduits 69. Due to this arrangement, the tool 70 may communicate with circuitry at the surface of the well for purposes of determining whether the running tool 70 has placed the power hanger 74 in the proper position inside the wellhead 12. In this manner, proximity to the electrical contacts 28 may be sensed by using the electrical connectors 29 so that the orientation of the tool 70 (and power hanger 74) may be determined. In some embodiments of the invention, power from the power cable assembly 16 may be used to power the running tool 70 either before or after the power hanger 74 has been set, according to the particular embodiment of the invention.

Among the other features depicted in FIG. 3A, in some embodiments of the invention, the power hanger 74 includes a protective sleeve 76 that is positioned on the interior surface of the power hanger 74. In this manner, the sleeve 76 includes a dielectric material and is biased (by a spring, for example) to extend upwardly to place the dielectric material over the connectors 62 after installation of the power hanger 74 and removal of the running tool 70. However, when the tool 70 is run downhole with the power hanger 74 attached, the protective sleeve 76 is retracted, a position that removes the dielectric material from the connectors 62, thereby preventing exposure to the connectors 62 so that the connectors 62 may be electrically coupled to the corresponding connectors 63 of the running tool 70.

Figure 4B:
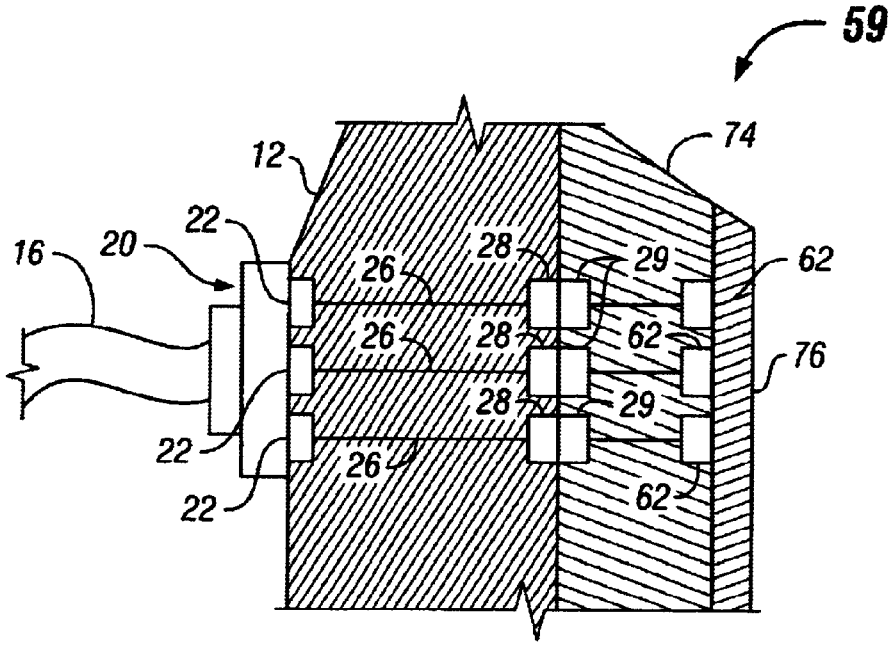
FIG. 4B is a more detailed schematic diagram of a selected portion of the well of FIG. 4A depicting electrical connections according to an embodiment of the invention.
Figure 4A:
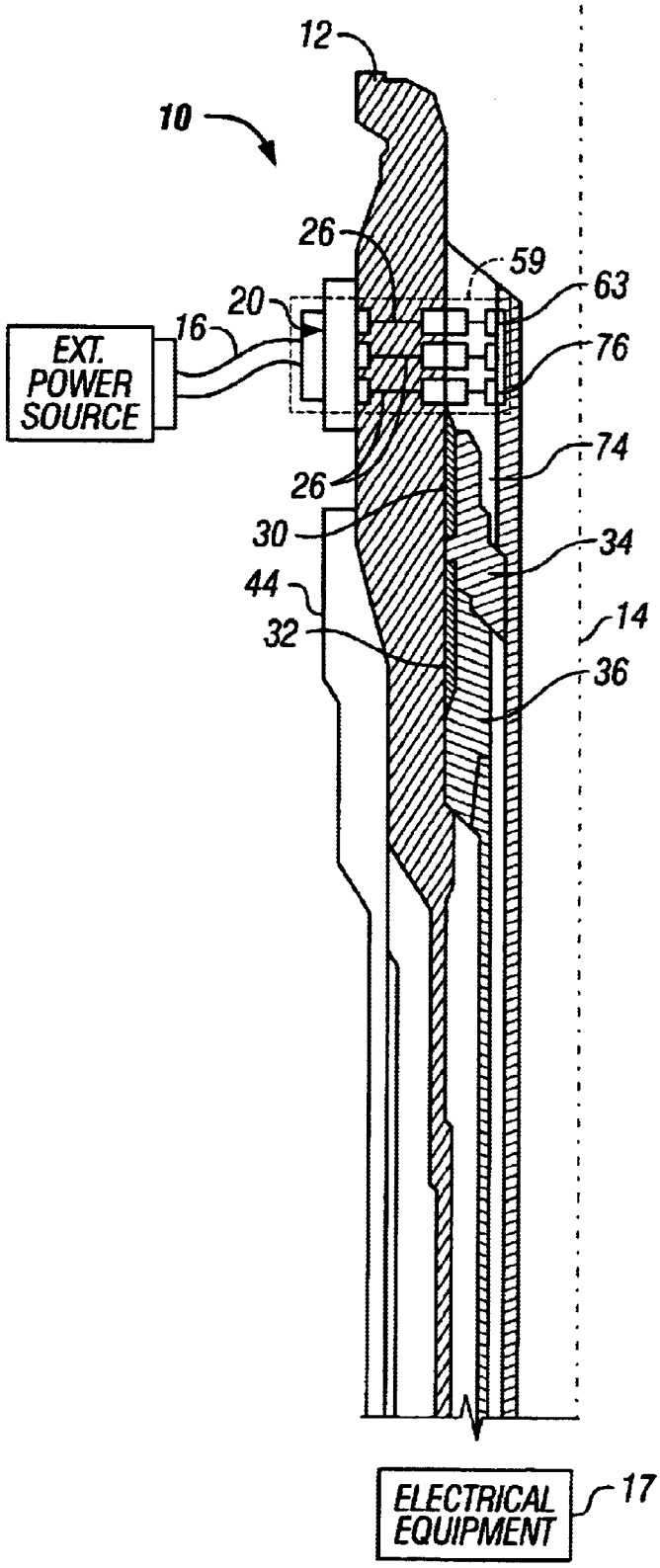
FIG. 4A is a schematic diagram of the well of FIG. 1 after the installation of the power hanger according to an embodiment of the invention.

FIG. 4A depicts the well 10 after the power hanger 74 has been set and the running tool 70 has been retrieved. The electrical connections in the well 10 are depicted in more detail in the portion 59 (of the well 10) that is shown in FIG. 4B. Referring both to FIGS. 4A and 4B, commands may be sent from the surface to cause the running tool 70 to set the power hanger 74. After verifying that the power hanger 74 has been properly set, commands may be communicated from the surface to unlatch the running tool 70 from the power hanger 74. In response to the running tool 70 being released and removed from the power hanger 74, the protective sleeve 76 extends to its protective position to cover the otherwise exposed electrical connectors 62 (FIG. 4B) on the interior surface of the power hanger 74.

Figure 5A:
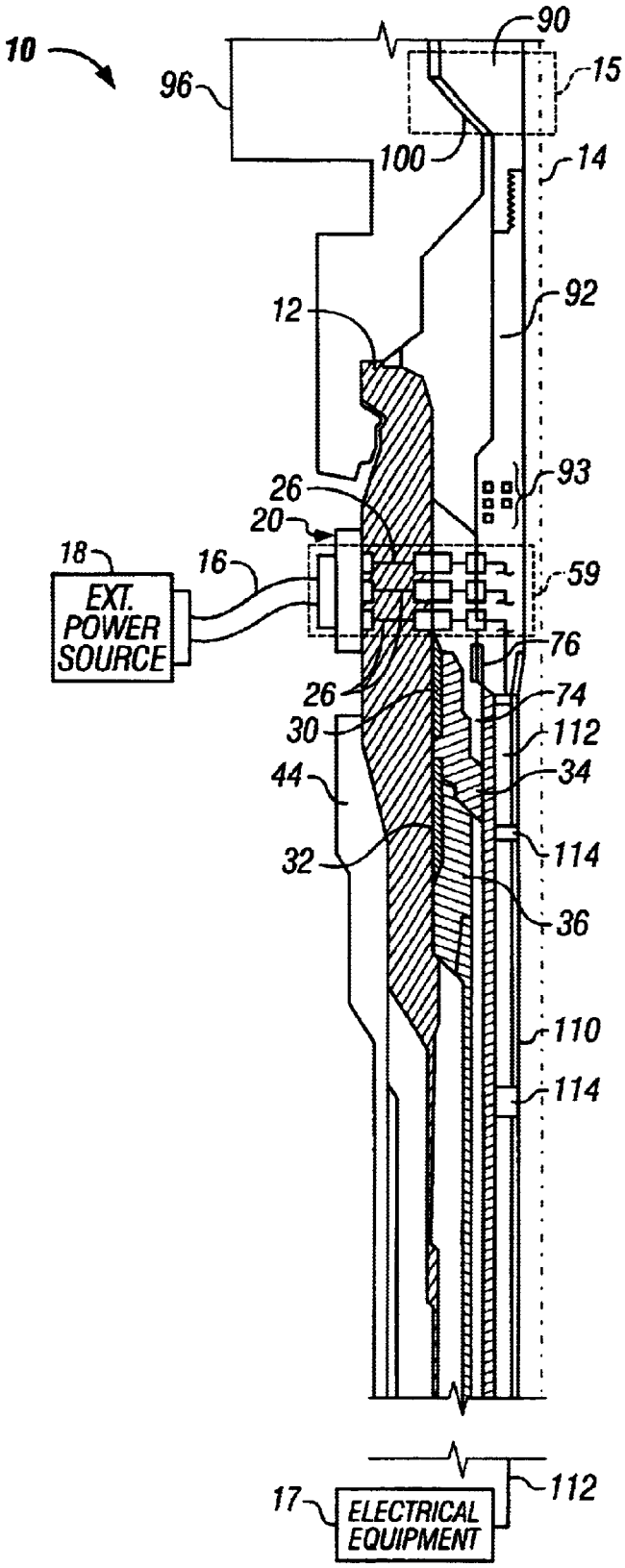
FIG. 5A is a schematic diagram of the well of FIG. 1 after the installation of a tubing hanger interface according to an embodiment of the invention.
Figure 5B:
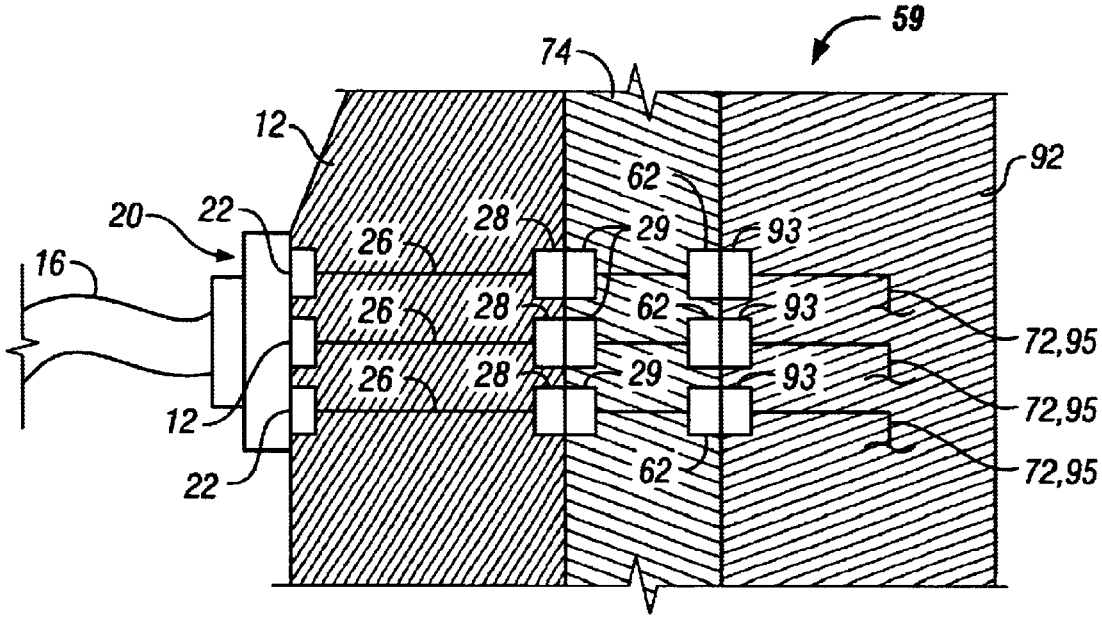
FIG. 5B is a more detailed schematic diagram of a selected portion of the well of FIG. 5A depicting electrical connections according to an embodiment of the invention.

FIG. 5A depicts the well after installation of a production tubing 110. FIG. 5B depicts a more detailed schematic diagram of the portion 59 showing electrical connections in the well 10. Referring to FIGS. 5A and 5B, for purposes of completing the well 10, the production tubing 110 is inserted into the wellbore of the well 10 with the top of the tubing 110 being connected (threadably connected, for example) to a tubing hanger extension 92. The extension 92, in turn, is threadably coupled to a tubing hanger interface 90. In this manner, the tubing hanger interface 90 rests on a corresponding annular shoulder 100 (part of the region 15) of the well tree 12 such that in this position, the production tubing 110 hangs into the wellbore.

As depicted in FIGS. 5A and 5B, the electrical connections for the well 10 penetrate the well 10 beneath the tubing hanger interface 90. This arrangement permits a cable 112 to be run downhole along the outside of the production tubing 110. In this manner, in some embodiments of the invention, the tubing hanger extension 92 includes electrical connectors 93 that, when the extension 92 is installed, align with the interior surface connectors 62 (FIG. 5B) of the power hanger 74. When the tubing hanger extension 92 is run into the well 10, the extension 92 pushes down on the protective sleeve 76 to retract the sleeve 76 for purposes of exposing the electrical connectors 62. Insulated electric wires 95 of the extension 92 extend through the tubing hanger extension 92 down to the cable 112 that houses the wires 95. The cable is located on the exterior surface of the production tubing 110 (FIG. 5A) and may be attached to the tubing 110 by clamps 114 (FIG. 5A), for example.

In some embodiments of the invention, part of the string may include radial ports 93 to inject dielectric fluid into the well prior to the mating of the electrical connectors 93 with the connectors 62. Similar to the radial ports 53 (FIG. 3A), the radial ports 93 flush the exposed electrical contact areas to improve contact connections and improve electrical insulation around these contacts. The flushing may be performed via a string that is run downhole separately from the string containing the tubing hanger 90 and tubing hanger extension 92, in some embodiments of the invention.

Figure 6A:
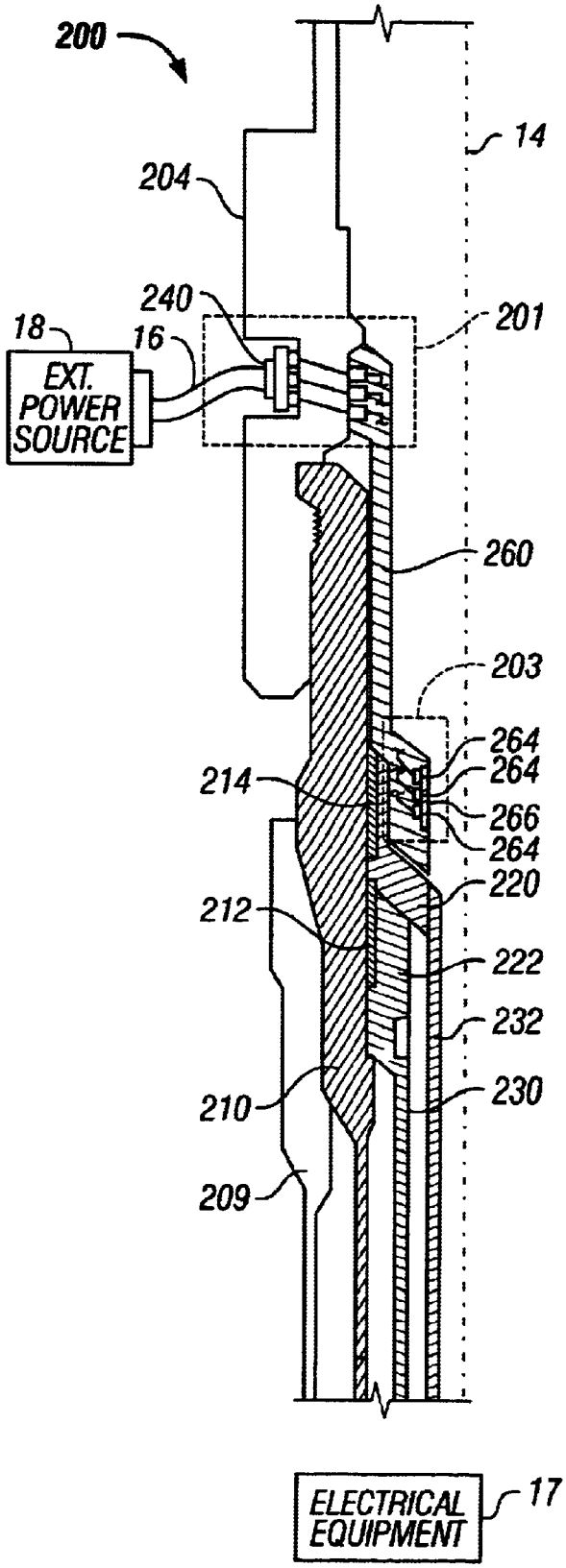
FIG. 6A is a schematic diagram of a well according to another embodiment of the invention depicting the well before installation of a tubing hanger interface.
Figure 6B:
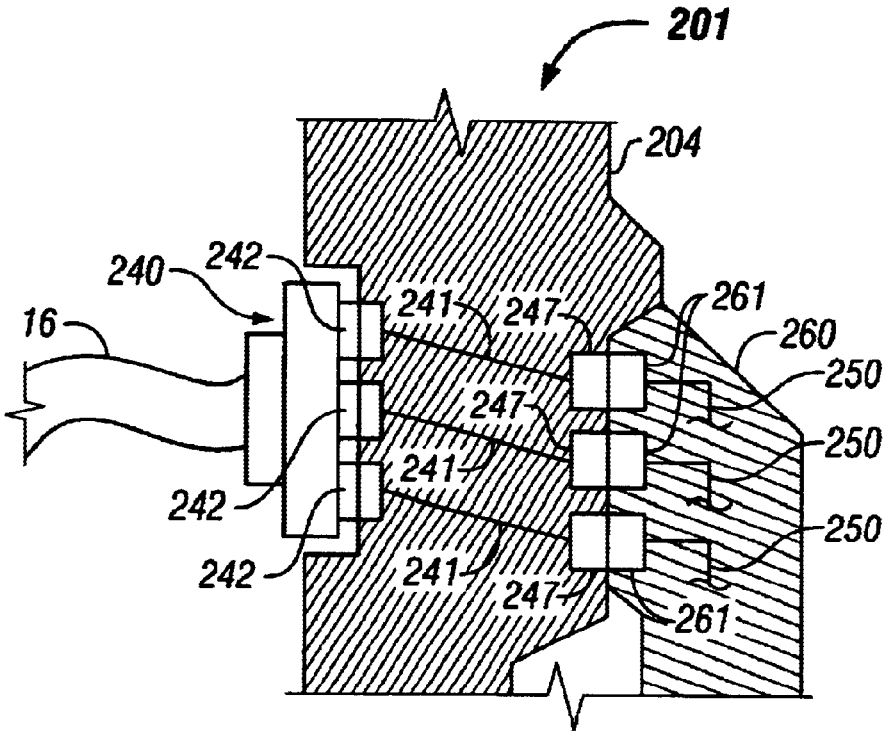
FIGS. 6B and 6C are more detailed schematic diagrams of selected portions of the well of FIG. 6A depicting electrical connections according to an embodiment of the invention.
Figure 6C:
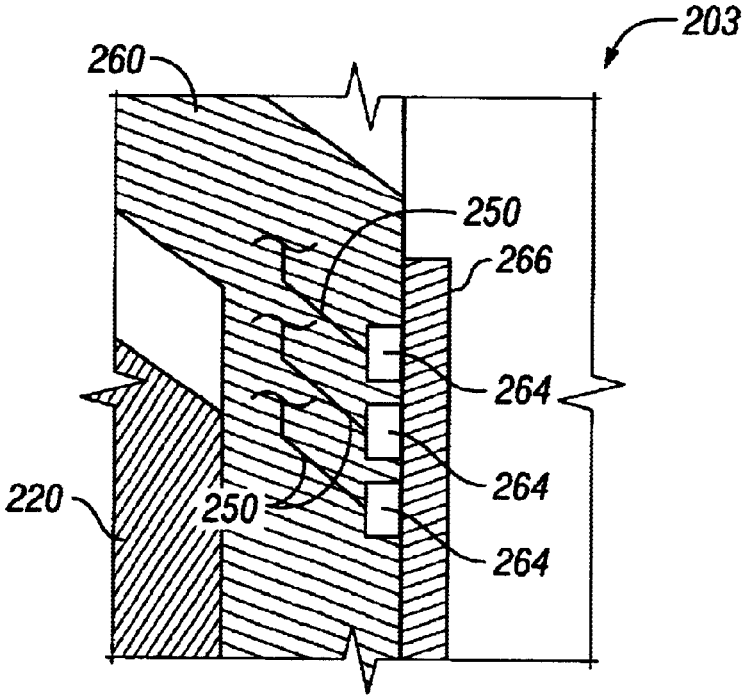

In some embodiments of the invention, the power connections pierce the well tree below the tubing hanger and do not pierce the wellhead. In this manner, FIG. 6A depicts a well 200 with such an arrangement. FIGS. 6B and 6C depict more detailed schematic diagrams of portions 201 and 203, respectively, of the well, showing in more detail the electrical connections in the well 200.

Referring to FIGS. 6A, 6B and 6C, in some embodiments of the invention, the power cable 16 extends from the power source 18 to a connector 240 that has contacts that mate with corresponding connectors 242 (FIG. 6B) that are located on the exterior surface of a sidewall of a well tree 204. Each connector 242 is associated with and connected to a different insulated conduit 241. The conduits 241, in turn, communicate electricity from the connectors 242 to corresponding connectors 247 (FIG. 6B) that are located on the interior surface of the sidewall of the well tree 204.

The well tree 204 is threadably connected to an interior sleeve 260 that has connectors 261 (FIG. 6B) that mate with the connectors 247, and furthermore, the sleeve 260 includes internal insulated wires 250 (FIG. 6B) that extend along the longitudinal length of the sleeve 260 to lower electrical connectors 264 (FIG. 6C) that are exposed on the interior surface of the sidewall of the sleeve 260. In some embodiments of the invention, a dielectric material of a protective sleeve 266 (FIG. 6C) covers the contacts 264 in an extended position of the sleeve 266. Similar to the protective sleeve 76, the protective sleeve 266 is biased (by a spring, for example) to extend to cover the contacts 264 when not pushed down by the presence of a tubing hanger extension, described below.

Also depicted in FIG. 6A, the well 200 may include a casing hanger 220 that is sealed to a wellhead 210 of the well 200 via a seal 214. The casing hanger 220 hangs a smaller diameter casing 232 into the well 200. Alternatively, a casing hanger 222 may be used in place of the casing hanger 220. The casing hanger 222 hangs a larger diameter well casing 230 into the well.

Figure 7A:
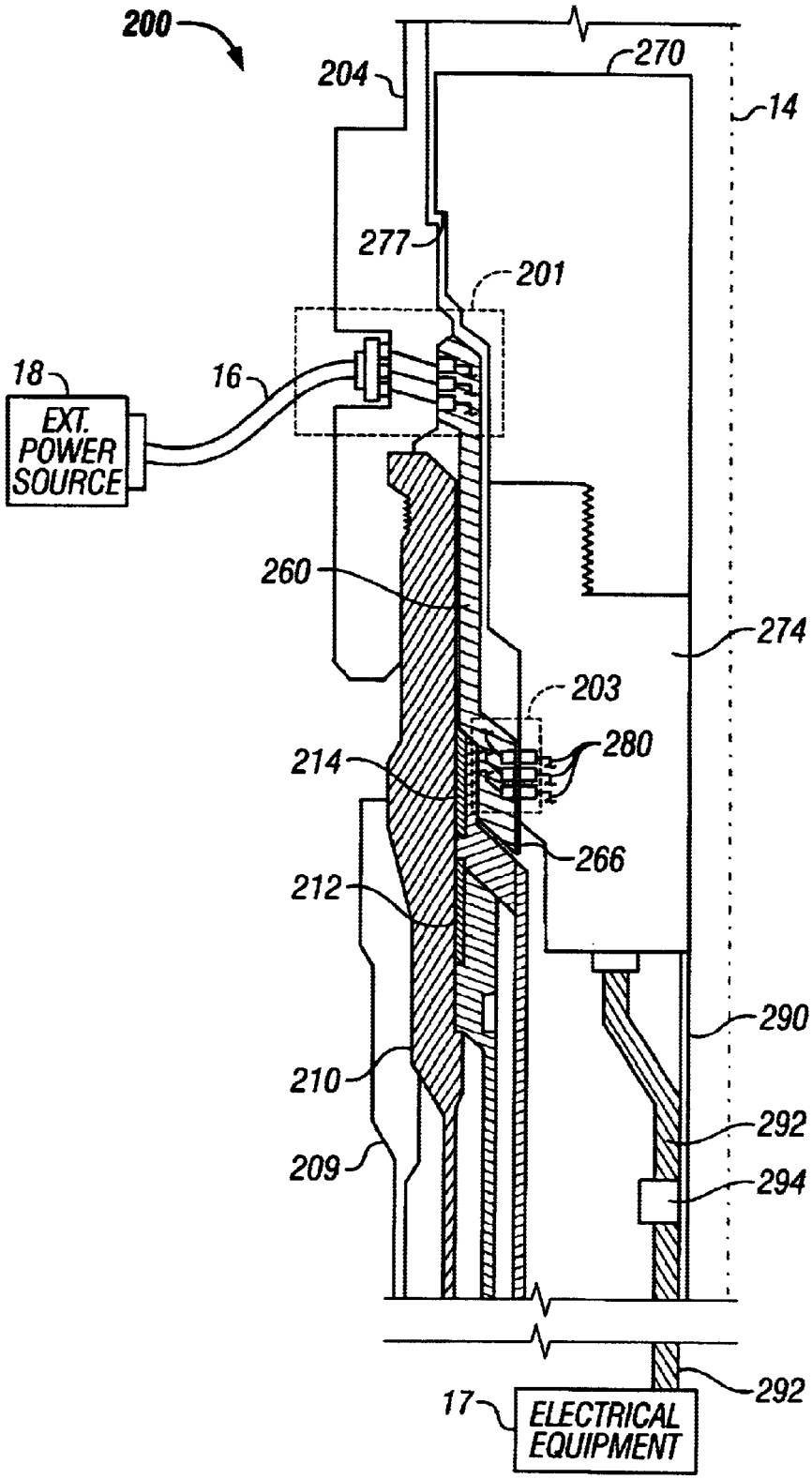
FIG. 7A is a schematic diagram of the well of FIG. 6A after the installation of the tubing hanger interface according to an embodiment of the invention.
Figure 7B:
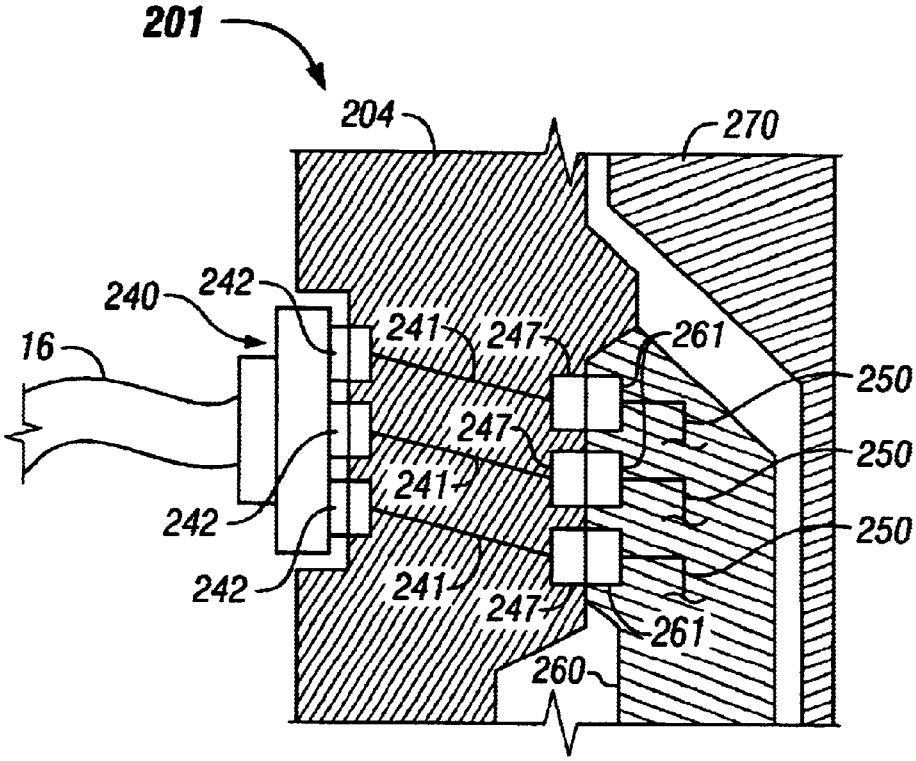
FIGS. 7B and 7C are more detailed schematic diagrams of selected portions of the well of FIG. 7A depicting electrical connections according to an embodiment of the invention.
Figure 7C:
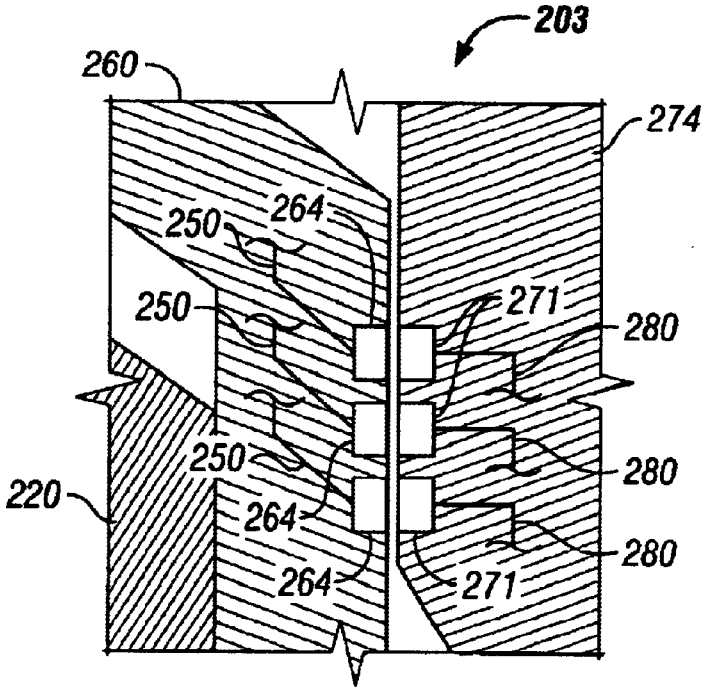

Referring to FIG. 7A, the electrical connections described above work in the following manner after a tubing hanger interface 270 and a tubing hanger extension 274 are installed in the well 200. FIGS. 7B and 7C depict more detailed schematic diagrams of portions 201 and 203, respectively, of the well, showing in more detail the electrical connections in the well 200.

Referring to FIGS. 7A, 7B and 7C, the tubing hanger extension 274 is threadably coupled to the lower end of the tubing hanger interface 270. The tubing hanger interface 270, in turn, rests on a corresponding annular shoulder 277 of the well tree 204.

After the tubing hanger 270 and tubing hanger extension 274 are installed, electrical connectors 271 (FIG. 7C) of the tubing hanger extension 274, which are formed on the exterior surface of the sidewall of the tubing hanger extension 274, contact corresponding electrical connectors 264 that extend on the interior sidewall of the sleeve 260. Insulated wires 280 of the tubing hanger extension 274 extend to a cable 292 that houses the wires 280. The cable 292 extends downhole on a production tubing 290 that is connected (threadably connected, for example) to the tubing hanger extension 274. The cable 292 may be held in place, for example, by one or more clamps 294 (FIG. 7A). Other variations are possible.

Similar to the other arrangements described above, in some embodiments of the invention, part of the string that includes the tubing hanger 270 and tubing hanger extension 274 may be used to inject dielectric fluid into the well prior to the mating of the electrical connectors 271 with the connectors 264. In this manner, the dielectric fluid flushes the exposed electrical contact areas to improve contact connections and improve electrical insulation around these contacts. The flushing may be performed via a string that is run downhole separately from the string that contains the tubing hanger 270 and tubing hanger extension 274, in some embodiments of the invention.

Other embodiments are within the scope of the following claims. For example, in some embodiments of the invention, the techniques and systems described above for electrical penetration of the well below the tubing hanger interface may be applied to extend chemical injection into the well. In this manner, the techniques described above may be applied to extending any type of communication into the well tree or wellhead below the tubing hanger interface. Such techniques and systems allow an effective increase in the cross-sectional area of the production tubing. As another example, the communication lines that penetrate the well tree or wellhead below the tubing hanger interface may be hydraulic control lines. Other variations are possible.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A system usable with a well, comprising:

a structure having a region adapted to receive a tubing hanger interface; and at least one communication connection to communicate electricity into the well, the connection penetrating the structure below the region to receive the tubing hanger interface.

2. The system of claim 1, wherein said at least one communication connection communicates electricity from an electrical power source external to the well into the well for use by electrical equipment located inside of the well.

3. The system of claim 2, wherein the structure comprises a wellhead and said at least one electrical connection penetrates the wellhead.

4. The system of claim 3, wherein said at least one electrical connection comprises insulated conduits that penetrate a sidewall of the wellhead.

5. The system of claim 3, wherein said at least one electrical connection comprises electrical conduits accessible from an interior surface of a sidewall of the wellhead.

6. The system of claim 3, wherein said at least one electrical connection comprises electrical conduits accessible from an exterior surface of sidewall of the wellhead.

7. The system of claim 3, further comprising:

a power hanger mounted inside of the wellhead.

8. The system of claim 7, wherein the power hanger comprises electrical connectors located on an interior surface of the power hanger to communicate electricity to a tubing hanger extension that is mounted inside of the power hanger.

9. The system of claim 8, wherein the power hanger comprises a retractable sleeve to protect the electrical connectors that are located on the interior surface.

10. The system of claim 7, wherein the power hanger comprises electrical connectors located on an exterior surface of the power hanger to communicate electricity from said at least one electrical connection.

11. The system of claim 7, further comprising:

a tubing hanger extension adapted to be mounted inside the power hanger, the tubing hanger extension comprising a conduit to communicate electricity provided by said at least one electrical connection to at least one downhole electrical cable.

12. The system of claim 2, wherein the structure comprises a well tree and said at least one electrical connection penetrates the well tree.

13. The system of claim 12, wherein said at least one electrical connection comprises insulated conduits that penetrate a sidewall of the well tree.

14. The system of claim 12, wherein the electrical connection comprises electrical connectors accessible from an interior surface of a sidewall of the well tree.

15. The system of claim 12, wherein said at least one electrical connection comprises electrical connectors accessible from an exterior surface of a sidewall of the well tree.

16. The system of claim 12, further comprising:

a power sleeve mounted inside of the well tree.

17. The system of claim 16, wherein the power sleeve comprises electrical connectors located on an interior surface of the power sleeve to communicate electricity to tubing hanger extension mounted inside of the power sleeve.

18. The system of claim 16, wherein the power sleeve comprises a retractable sleeve to protect the electrical connectors that are located on the interior surface.

19. The system of claim 16, wherein the power sleeve comprises electrical connectors located on an exterior surface of the power sleeve to communicate electricity from said at least one electrical connection.

20. The system of claim 16, further comprising:

a tubing hanger extension adapted to be mounted inside the power sleeve, the tubing hanger extension comprising a wire to communicate electricity provided by said at least one electrical connection to at least one downhole electrical cable.

21. The system of claim 1, wherein the well comprises a subsea well.

22. The system of claim 1, wherein the structure comprises a well tree.

23. The system of claim 1, wherein the structure comprises a wellhead.

24. A method usable with a well, comprising:

installing a tubing hanger interface in a structure of the well; and penetrating the structure below the tubing hanger interface to establish at least one communication to communicate electricity into the well.

25. The method of claim 24, wherein the penetrating comprises penetrating a wellhead.

26. The method of claim 25, wherein the penetrating comprises extending electrical conduits through a sidewall of the wellhead.

27. The method of claim 25, further comprising:

installing a power hanger in the well to establish electrical communication to a tubing hanger extension located in the well.

28. The method of claim 24, wherein the penetrating comprises penetrating a well tree of the well.

29. The method of claim 28, wherein the penetrating comprises extending at least one electrical conduit through a sidewall of the well tree.

30. The method of claim 28, further comprising:

mounting a power sleeve to the well tree;

installing the well tree and power sleeve concurrently in the well; and subsequent to the installation of the power sleeve and well tree, installing a tubing hanger interface in the well.

31. A power system for providing power and communications to downhole devices in a well having a tubing hanger interface, comprising:

an external power source;

a downhole structure having external electrical contacts connected therethrough the downhole structure to internal electrical contacts, the external electrical contacts are in communication with the external power source and are located below the tubing hanger interface; and a power structure having outer electrical contacts in communication with inner electrical contacts, the outer electrical contacts adapted for communication with the internal electrical contacts of the downhole structure, and the inner electrical contacts adapted to supply power to downhole devices.

32. The power system of claim 31, wherein the downhole structure comprises a wellhead.

33. The power system of claim 31, wherein the downhole structure comprises a well tree.

34. The power system of claim 31, wherein the power structure comprises a power hanger device.

35. The power system of claim 31, wherein the power structure comprises a power sleeve.

36. A system usable with a well, comprising:

a structure having a region adapted to receive a tubing hanger interface; and at least one communication connection to communicate a chemical into the well, the connection penetrating the structure below the region to receive the tubing hanger interface.

37. The system of claim 34, wherein the well comprises a subsea well.

38. The system of claim 36, wherein the structure comprises a well tree.

39. The system of claim 36, wherein the structure comprises a wellhead.

40. A method usable with a well, comprising:

installing a tubing hanger interface in a structure of the well; and penetrating the structure below the tubing hanger interface to establish at least one communication connection to communicate a chemical into the well.

41. The method of claim 40, wherein the penetrating comprises penetrating a well tree of the well.

42. The method of claim 40, wherein the well comprises a subsea well.

43. The method of claim 40, wherein the structure comprises a well tree.

44. The method of claim 40, wherein the structure comprises a wellhead.

45. A system usable with a well, comprising:

a structure having a region adapted to receive a tubing hanger interface and having an opening penetrating the structure below the region; and a conduit received in the opening.

46. The system of claim 45, wherein the conduit is adapted to communicate electricity.

47. The system of claim 45, wherein the conduit is adapted to communicate a chemical into the well.

48. The system of claim 45, wherein the well comprises a subsea well.

49. The system of claim 45, wherein the structure comprises a well tree.

50. The system of claim 45, wherein the structure comprises a wellhead.

51. A method usable with a well, comprising:

installing a tubing hanger interface in a structure of the well; and penetrating the structure to establish an opening below the tubing hanger interface; and receiving a conduit in the opening.

52. The method of claim 51, further comprising:

communicating electricity through the conduit.

53. The method of claim 51, further comprising:

communicating a chemical through the conduit.

54. The method of claim 51, wherein the penetrating comprises penetrating a well tree of the well.

55. The method of claim 51, wherein the well comprises a subsea well.

56. The method of claim 51, wherein the structure comprises a well tree.

57. The method of claim 51, wherein the structure comprises a wellhead.

* * * * *